US011636971B2

(12) United States Patent
Jung et al.

(10) Patent No.: US 11,636,971 B2
(45) Date of Patent: Apr. 25, 2023

(54) COIL COMPONENT

(71) Applicant: SAMSUNG ELECTRO-MECHANICS CO., LTD., Suwon-si (KR)

(72) Inventors: Ye Eun Jung, Suwon-si (KR); Jin Gul Hyun, Suwon-si (KR); Han Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 429 days.

(21) Appl. No.: 16/786,132

(22) Filed: Feb. 10, 2020

(65) Prior Publication Data

US 2021/0043359 A1 Feb. 11, 2021

(30) Foreign Application Priority Data

Aug. 9, 2019 (KR) ..... 10-2019-0097279

(51) Int. Cl.
*H01F 27/29* (2006.01)
*H01F 27/00* (2006.01)
(Continued)

(52) U.S. Cl.
CPC ..... *H01F 27/255* (2013.01); *H01F 17/0013* (2013.01); *H01F 17/04* (2013.01);
(Continued)

(58) Field of Classification Search
CPC ..... H01F 17/0013; H01F 27/255; H01F 27/2804; H01F 27/292; H01F 2017/048;
(Continued)

(56) References Cited

U.S. PATENT DOCUMENTS 7,705,704 B2 * 4/2010 Lee ..... H01F 17/0006 336/200
2008/0157913 A1 * 7/2008 Kim ..... H01F 17/0013 336/200
(Continued)

FOREIGN PATENT DOCUMENTS

EP 1085538 A1 3/2001
JP 2001-85230 A 3/2001
(Continued)

OTHER PUBLICATIONS

Korean Office Action dated Mar. 1, 2023, issued in corresponding Korean Patent Application No. 10-2019-0097279 with English translation.

*Primary Examiner* — Hoa C Nguyen
(74) *Attorney, Agent, or Firm* — Morgan, Lewis & Bockius LLP

(57) ABSTRACT

A coil component includes a body including a plurality of effective layers stacked in one direction; a coil portion embedded in the body, the coil portion including a plurality of coil patterns respectively disposed in the plurality of effective layers, the coil portion further including a lead-out pattern; and a core penetrating through an interior of the coil portion, wherein the coil portion further includes a resistance reducing portion extending from an outer circumferential surface of each of the coil patterns to an outside of the core in a respective one of the effective layers in a radially outward direction of the coil portion.

19 Claims, 6 Drawing Sheets

(51) Int. Cl.

| | |
|---|---|
| ***H01F 27/255*** | (2006.01) |
| ***H01F 17/00*** | (2006.01) |
| ***H01F 17/04*** | (2006.01) |
| ***H01F 27/28*** | (2006.01) |

(52) U.S. Cl.
CPC ..... *H01F 27/2804* (2013.01); *H01F 27/292* (2013.01); *H01F 2017/0066* (2013.01); *H01F 2017/0073* (2013.01); *H01F 2017/048* (2013.01); *H01F 2027/2809* (2013.01)

(58) Field of Classification Search
CPC ..... H01F 2017/2809; H01F 2017/066; H01F 2017/0073
See application file for complete search history.

(56) References Cited

U.S. PATENT DOCUMENTS

| | | | | |
|---|---|---|---|---|
| 2011/0074535 | A1* | 3/2011 | Banno | H01F 27/292 336/200 |
| 2013/0335185 | A1* | 12/2013 | Hahn | H01F 17/0013 336/200 |
| 2016/0343489 | A1* | 11/2016 | Horikawa | H01F 17/0013 |
| 2016/0379746 | A1* | 12/2016 | Yoshioka | H01F 27/2823 336/220 |
| 2017/0103846 | A1 | 4/2017 | Yoneda | |
| 2017/0110234 | A1* | 4/2017 | Nishikawa | H01F 17/0013 |
| 2018/0012697 | A1 | 1/2018 | Jung et al. | |
| 2018/0012700 | A1 | 1/2018 | Lee et al. | |
| 2018/0308617 | A1 | 10/2018 | Ha et al. | |
| 2019/0148060 | A1* | 5/2019 | Arai | H01F 27/346 336/192 |

FOREIGN PATENT DOCUMENTS

| | | | |
|---|---|---|---|
| JP | 6217861 | B2 | 10/2017 |
| KR | 10-2011-0128553 | A | 11/2011 |
| KR | 10-2018-0006247 | A | 1/2018 |
| KR | 10-2018-0006262 | A | 1/2018 |
| KR | 10-2018-0117464 | A | 10/2018 |

* cited by examiner

COIL COMPONENT

CROSS-REFERENCE TO RELATED APPLICATION(S)

The present application claims the benefit of priority to Korean Patent Application No. 10-2019-0097279 filed on Aug. 9, 2019 in the Korean Intellectual Property Office, the entire disclosure of which is incorporated herein by reference.

TECHNICAL FIELD

The present disclosure relates to a coil component.

BACKGROUND

With miniaturization and high performance being implemented in electronic devices, miniaturization and high performance are required for coil components used in electronic devices. In other words, coil components are gradually miniaturized, and even in this case, characteristics of the components such as inductance (Ls), a Q factor, and the like, need to be secured.

On the other hand, in order to secure the Q value, a quality factor, direct current (DC) resistance (Rdc) of the coil portion should be lowered. However, since there may be a concern such as a decrease in the inductance (Ls), a certain limitation to an increase in an area of the coil portion, lowering the DC resistance (Rdc), may occur.

SUMMARY

An aspect of the present disclosure is to provide a coil component capable of minimizing a decrease in inductance (Ls) while reducing DC resistance (Rdc).

According to an aspect of the present disclosure, a coil component includes a body including a plurality of effective layers stacked in one direction; a coil portion embedded in the body, the coil portion including a plurality of coil patterns respectively disposed in the plurality of effective layers, the coil portion further including a lead-out pattern; and a core penetrating through an interior of the coil portion, wherein the coil portion further includes a resistance reducing portion extending from an outer circumferential surface of each of the coil patterns to an outside of the core in a respective one of the effective layers in a radially outward direction of the coil portion.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
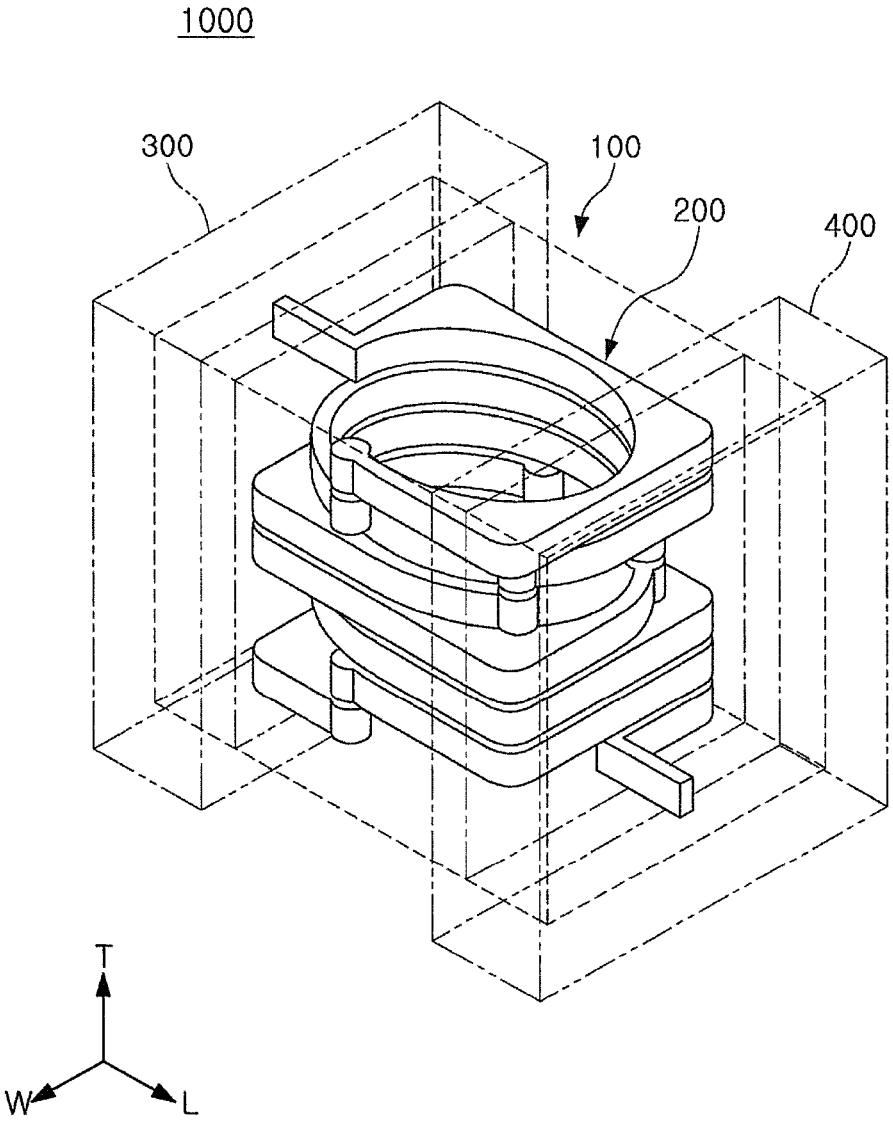
FIG. 1 is a view schematically illustrating a coil component according to an exemplary embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length direction, a W direction is a second direction or a width direction, a T direction is a third direction or a thickness direction.

Hereinafter, a coil component according to an exemplary embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

First Embodiment

Figure 2:
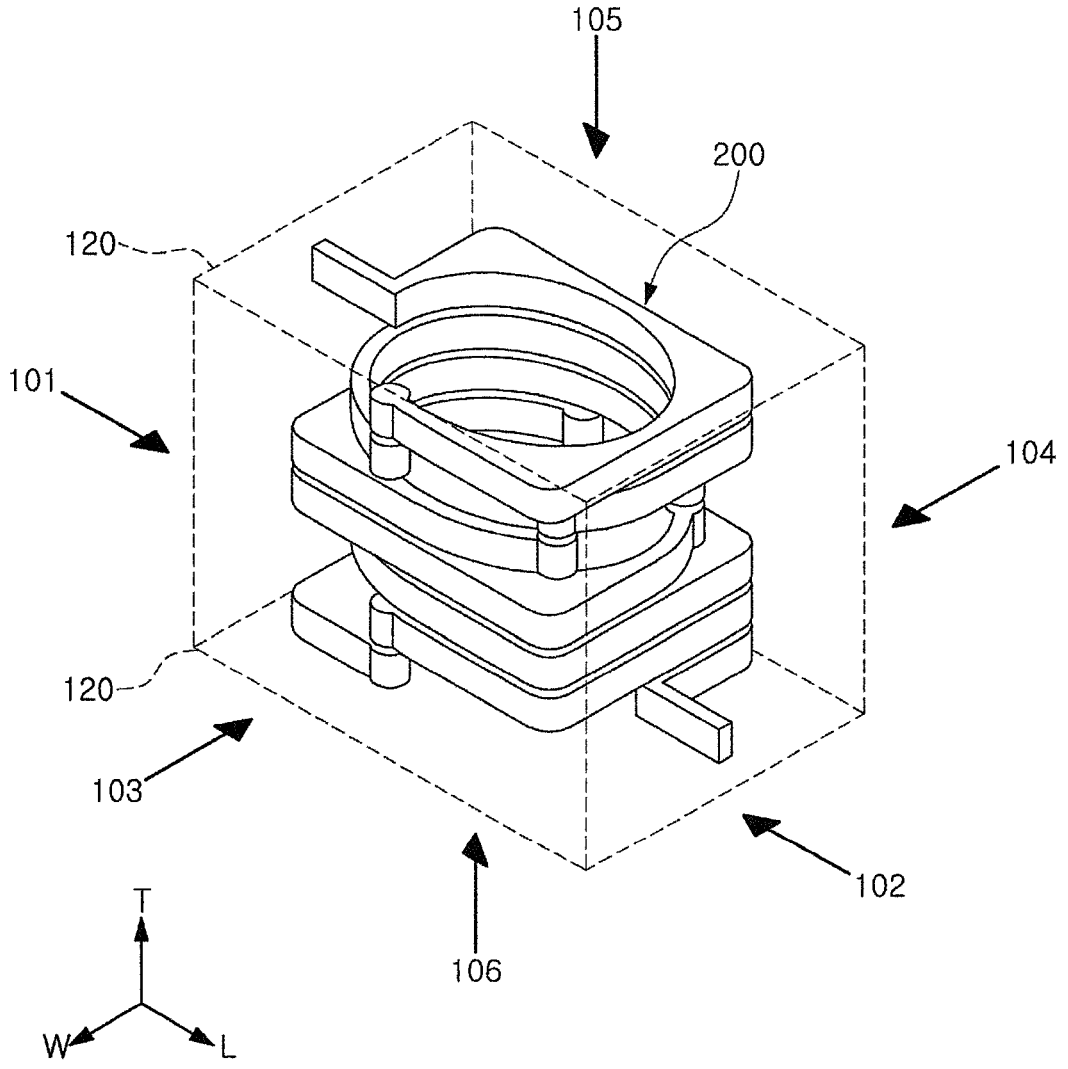
FIG. 2 is a view schematically illustrating a body and a coil portion applied to an exemplary embodiment of the present disclosure.
Figure 3:
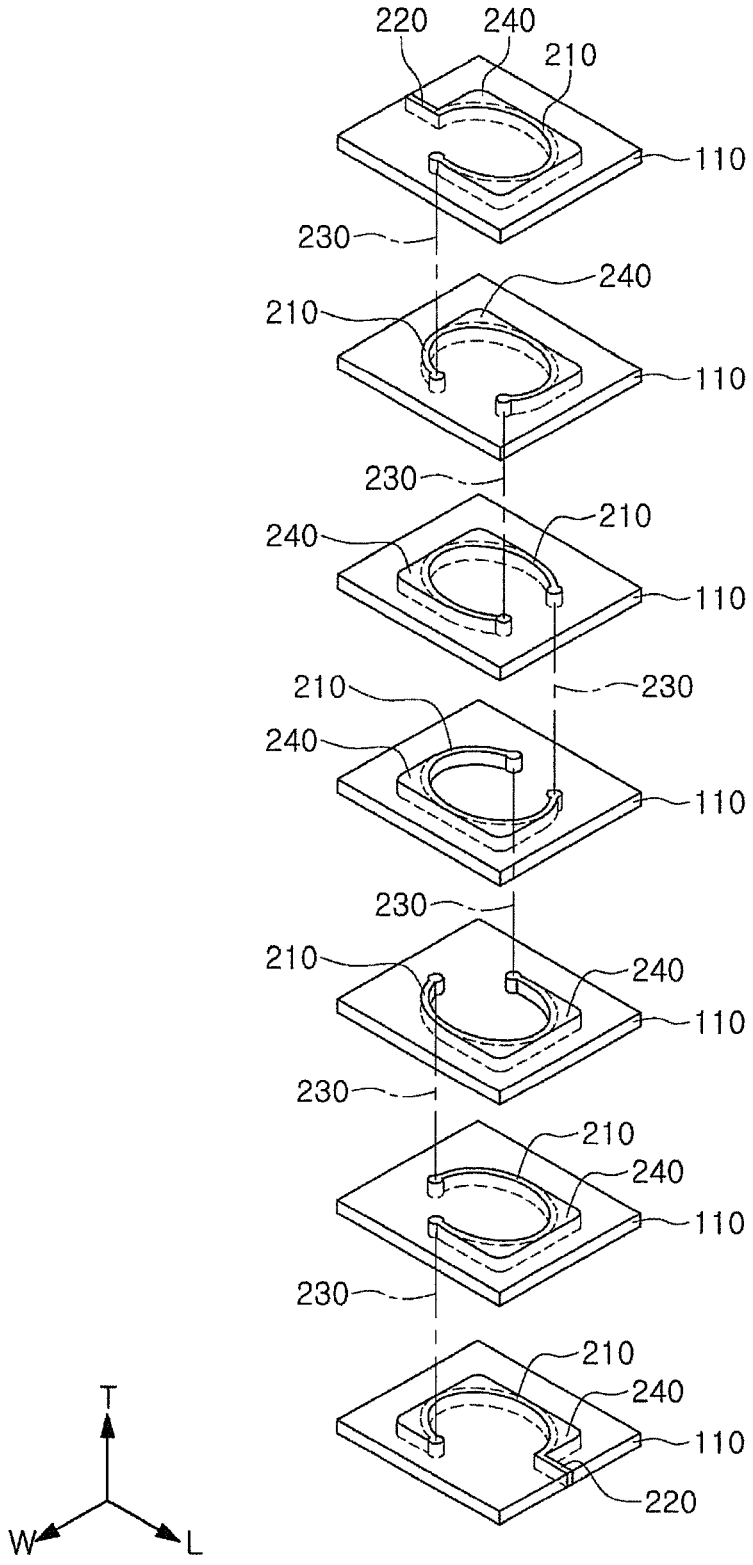
FIG. 3 is an exploded perspective view of FIG. 1.
Figure 4:
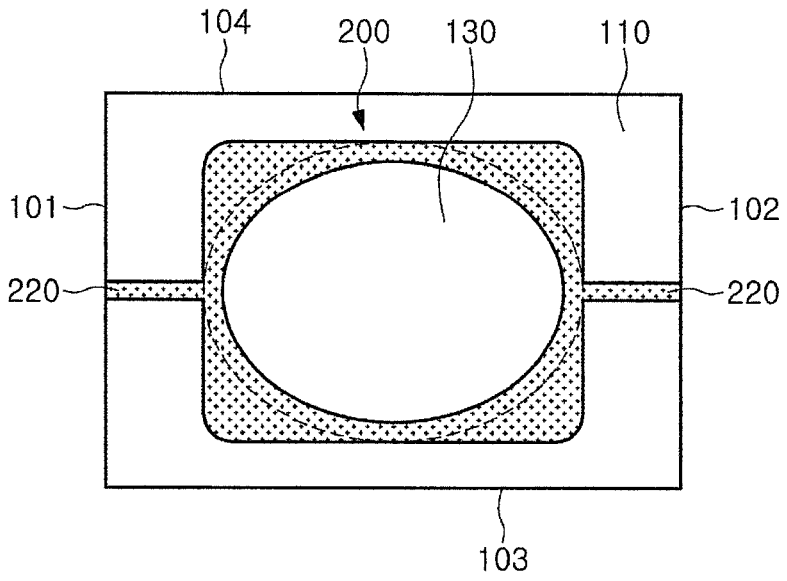
FIG. 4 is a view of FIG. 1, when projected in a thickness direction T of FIG. 1.

FIG. 1 is a view schematically illustrating a coil component according to an exemplary embodiment of the present disclosure. FIG. 2 is a view schematically illustrating a body and a coil portion applied to an exemplary embodiment of the present disclosure. FIG. 3 is an exploded perspective view of FIG. 1. FIG. 4 is a view of FIG. 1, when projected in a thickness direction T of FIG. 1. FIG. 3 illustrates only an effective layer 110 and a coil portion 200, main components, for convenience of description.

Referring to FIGS. 1 to 4, a coil component 1000 according to an exemplary embodiment of the present disclosure may include a body 100, a coil portion 200, and external electrodes 300 and 400. The body 100 may include a plurality of effective layers 110 and a cover layer 120. In addition, the body 100 may include a core 130 passing through a coil pattern 210 of the coil portion 200 to be described later as a portion of the body 100.

The body 100 may form an appearance of the coil component 1000 according to this embodiment, and may embed the coil portion 200 therein.

The body 100 may be formed to have a hexahedral shape overall.

Referring to FIGS. 1 and 2, the body 100 may include a first surface 101 and a second surface 102 facing each other in a longitudinal direction L, a third surface 103 and a fourth surface 104 facing each other in a width direction W, and a fifth surface 105 and a sixth surface 106 facing each other in a thickness direction T. Each of the first to fourth surfaces 101, 102, 103, and 104 of the body 100 may correspond to wall surfaces of the body 100 connecting the fifth surface 105 and the sixth surface 106 of the body 100. Hereinafter, both end surfaces of the body 100 may refer to the first surface 101 and the second surface 102 of the body, and both side surfaces of the body 100 may refer to the third surface 103 and the fourth surface 104 of the body.

The body 100 may, for example, be formed such that the coil component 1000 according to this embodiment in which the external electrodes 300 and 400 to be described later are formed has a length of 2.0 mm, a width of 1.2 mm, and a thickness of 0.65 mm, but is not limited thereto.

The body 100 may be formed by stacking the cover layer 120 and the plurality of effective layers 110 in the thickness direction T.

For example, the body 100 may be formed by stacking a plurality of green sheets for forming the effective layers and a green sheet for forming the cover layer, and sintering them. In the case of the above-described method, it may be difficult to distinguish a boundary between the effective layers 110, and a boundary between each of the effective layer 110 and the cover layer 120, after the sintering operation. The green sheet for forming the effective layers and the green sheet for forming the cover layer may be formed of the same ceramic slurry, but are not limited thereto.

As another example, the body 100 may be formed by stacking a plurality of magnetic composite sheets including magnetic powder and an insulating resin, and curing them. As another example, the body 100 may be formed by stacking a plurality of composite sheets including dielectric powder particle and an insulating resin, and curing them. The plurality of magnetic composite sheets or composite sheets may be cured to become the effective layers 110 and the cover layer 120 of the present disclosure.

The magnetic powder particle may be a ferrite powder particle or a metal magnetic powder particle.

Examples of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder particle may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder particle may be amorphous or crystalline. For example, the metal magnetic powder particle may be a Fe—Si—B—Cr-based amorphous alloy powder particle, but is not limited thereto.

The dielectric powder particle may include at least one of an organic filler and an inorganic filler.

The organic filler may include at least one of, for example, acrylonitrile-butadiene-styrene (ABS), cellulose acetate, nylon, poly(methyl methacrylate) (PMMA), polybenzimidazole, polycarbonate, polyether sulfone, polyether ether ketone (PEEK), polyetherimide (PEI), polyethylene, polylactic acid, polyoxymethylene, polyphenylene oxide, polyphenylene sulfide, polypropylene, polystyrene, polyvinyl chloride, ethylene vinyl acetate, polyvinyl alcohol, polyethylene oxide, epoxy, polyimide.

The inorganic filler may include at least one or more selected from the group consisting of silica ($SiO_2$), alumina ($Al_2O_3$), silicon carbide (SiC), titanium oxide ($TiO_2$), barium sulfate ($BaSO_4$), aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$). In addition, the range of the inorganic filler of this embodiment is not limited to the above-mentioned example. A ceramic material which has a value whose specific permeability is close to 1 may belong to the inorganic filler of this embodiment.

The magnetic powder particle and the dielectric powder particle may each have an average diameter of about 0.1 μm to 30 μm, but are not limited thereto.

The insulating resin may include an epoxy, a polyimide, a liquid crystal polymer, or the like, in a single form or in combined forms, but is not limited thereto.

The coil portion 200 may be embedded in the body 100 to manifest the characteristics of the coil component. For example, when the coil component 1000 of this embodiment is used as a power inductor, the coil portion 200 may function to stabilize power supply of an electronic device by storing an electric field as a magnetic field and maintaining an output voltage.

The coil portion 200 may include a coil pattern 210, a lead-out pattern 220, and a via 230 formed in the effective layers 110, and may further include a resistance reducing portion 240.

The coil pattern 210, the lead-out pattern 220, the resistance reducing portion 240, and the via 230 may be formed in a form embedded in the body 100 by applying a metal paste, for example, at least one metal selected from nickel (Ni), aluminum (Al), iron (Fe), copper (Cu), titanium (Ti), chromium (Cr), gold (Au), silver (Ag), palladium (Pd), platinum (Pt), or the like, or a metal compound thereof, on the green sheet for forming an effective layer, by screen printing, etc., and sintering it together with the green sheet at the same time. As another example, the coil pattern 210, the lead-out pattern 220, the resistance reducing portion 240, and the via 230 may be formed on each of the effective layers 110 by an electroplating process. In this case, the coil pattern 210, the lead-out pattern 220, the resistance reducing portion 240, and the via 230 may include a seed layer formed by an electroless plating process or a sputtering process, and an electroplating layer formed on the seed layer.

The coil patterns 210 formed on each of the effective layers 110 may be interconnected through the vias 230 passing through each of the effective layers 110 in the thickness direction T, to form a single coil winding the magnetic core 130 a plurality of times in the thickness direction T.

Each of the coil patterns 210 may be formed in each of the effective layers 110 to have a circular shape open to one side or an elliptical shape open to one side. For example, each of the coil patterns 210 may be formed in each of the effective layers 110 to have a number of turns less than 1. As a result, as illustrated in FIG. 4, when the coil portion 200 and the core 130 are projected in the thickness direction T of FIG. 1, the core 130 may have a circular or elliptical shape. Since each of the coil patterns 210 may be formed in the open circular shape or the open oval shape, concentration of current may occur at a vertex to prevent deteriorations in current flow.

The lead-out pattern 220 may extend from the coil pattern 210 disposed in an uppermost layer or a lowermost layer in the thickness direction T to the first and second surfaces 101 and 102 of the body 100. The lead-out pattern 220 may be exposed to the first and second surfaces 101 and 102 of the body 100, respectively, and may be connected to the external electrodes 300 and 400 to be described later.

The resistance reducing portion 240 may extend from an outer circumferential surface of the coil pattern 210 to an outside of the core 130 in each of the effective layers 110 in a radially outward direction of the coil portion 200. For example, the resistance reducing portion 240 may increase a cross-sectional area of the coil pattern 210.

In order to reduce the DC resistance (Rdc) of the coil components, flow of current should be improved. The flow of current may be improved by changing a pattern shape of the coil pattern or increasing a cross-sectional area (a line width) of the coil pattern. As an example of the former case, to reduce relatively the concentration of current at a vertex to be generated, the coil pattern may be formed to have a square shape to be rounded at the vertex. As an example of the latter case, the DC resistance (Rdc) may be improved, but when areas of the effective layers are the same, the cross-sectional area of the core may be reduced to cause a decrease in inductance (Ls).

In this embodiment, the resistance reducing portion 240 may extend from an outer circumferential surface of the coil pattern 210 to the outside of the core 130 in the radially outward direction of the coil portion 200. Therefore, the resistance reducing portion 240 in each of the effective layers 110 having the same area may increase the area of the coil pattern 210, but may not reduce the cross-sectional area of the core 130.

The resistance reducing portion 240 may be disposed in a region between four vertices of the effective layer 110 and the coil pattern 210. Since the coil pattern 210 of this embodiment may be formed as an open circular shape or an open elliptical shape overall, a region on one surface of the effective layer 110 between the coil pattern 210 and each of the four vertices of the effective layer 110 may have the greatest area. The resistance reducing portion 240 may be disposed in such a region, to maximize an increase in the cross-sectional area of the coil pattern 210.

The resistance reducing portion 240 may be disposed, in plural, with regard to each of the coil patterns 210. For example, the resistance reducing portion 240 may be disposed in an appropriate number in the above four regions on one surface of the effective layer 110, in consideration of a shape of the coil pattern 210 of a layer to be desired. For example, since the uppermost coil pattern 210 disposed in the uppermost effective layer 110, illustrated in FIG. 3, forms ¾ turns, a total of three resistance reducing portions 240 may be arranged on the uppermost coil pattern 210. Since the number of turns of each of the coil patterns 210 and the number and positions of the resistance reducing portions 240 formed in each of the coil patterns 210, illustrated in FIGS. 1 and 3, are merely illustrative, the number of turns of each of the coil patterns 210 and the number and positions of the resistance reducing portions 240 formed in each of the coil patterns 210 are not limited to those illustrated in FIGS. 1 and 3.

Due to the resistance reducing portion 240 extending from the coil pattern 210, when the coil portion 200 and the effective layer 110 are projected in the thickness direction T of FIG. 1, an interior of the coil portion 200 may be passed through by the core 130 having a circular shape or an elliptical shape, and an outside of the coil portion 200 may be formed in a rectangular shape overall. In this case, the vertices of the rectangle may be formed to have a rounded shape. As a result, it is possible to prevent current from concentrating at the vertex of the resistance reducing portion 240, and deteriorating the flow of current. The shape of the resistance reducing portion 240 is not limited to those illustrated in FIGS. 1 to 4. Therefore, when the coil portion 200 and the effective layer 110 are projected in the thickness direction T of FIG. 1, even in a case that the outside of the coil portion 200 has a polygonal shape instead of a rectangular shape, it may be within the scope of the present disclosure. Even in this case, as described above, the vertices having a polygonal shape may be formed in a rounded shape.

The first and second external electrodes 300 and 400 may be arranged on the first and second surfaces 101 and 102 of the body 100, and may be connected to the lead-out pattern 220 of the coil portion 200, respectively.

The first and second external electrodes 300 and 400 may have a single-layer structure or a multilayer structure. For example, each of the first and second external electrodes 300 and 400 may include a first layer comprising copper (Cu), a second layer disposed on the first layer and comprising nickel (Ni), and a third layer disposed on the second layer and comprising tin (Sn). The first and second external electrodes 300 and 400 may be formed by a plating method, a paste printing method, or the like. As a non-limiting example, each of the first and second external electrodes 300 and 400 may include a first layer formed by directly applying a conductive paste containing a conductive powder particle to the body, and curing or sintering the first and second layers, and a second layer formed by an electrolytic plating process using the first layer as an underlayer.

The first and second external electrodes 300 and 400 may be formed of a conductive material such as copper (Cu), aluminum (Al), silver (Ag), tin (Sn), gold (Au), nickel (Ni), lead (Pb), titanium (Ti), or alloys thereof, but is not limited thereto.

In FIG. 1, for example, although the first external electrode 300 is illustrated as a five-sided electrode formed on the first surface 101 of the body 100, and extending to each of the third to sixth surfaces 103, 104, 105, and 106 of the body 100, it is not limited thereto. As another example, each of the first and second external electrodes 300 and 400 may be an L-shaped electrode formed on the first and second surfaces 101 and 102 of the body 100, and extending to the sixth surface 106 of the body 100. As another example, each of the first and second external electrodes 300 and 400 may be a c-shaped electrode formed on the first and second surfaces 101 and 102 of the body 100, and extending to the fifth and sixth surfaces 105 and 106 of the body 100.

Although not illustrated in the drawings, the coil component 1000 according to this embodiment may further include an insulating layer disposed in a region, other than regions in which the external electrodes 300 and 400 among the first to sixth surfaces 101, 102, 103, 104, 105, and 106 of the body 100 are formed. The insulating layer may function as a plating resist in forming the external electrodes 300 and 400 by the electroplating process, but is not limited thereto.

Other Embodiment

Figure 5:
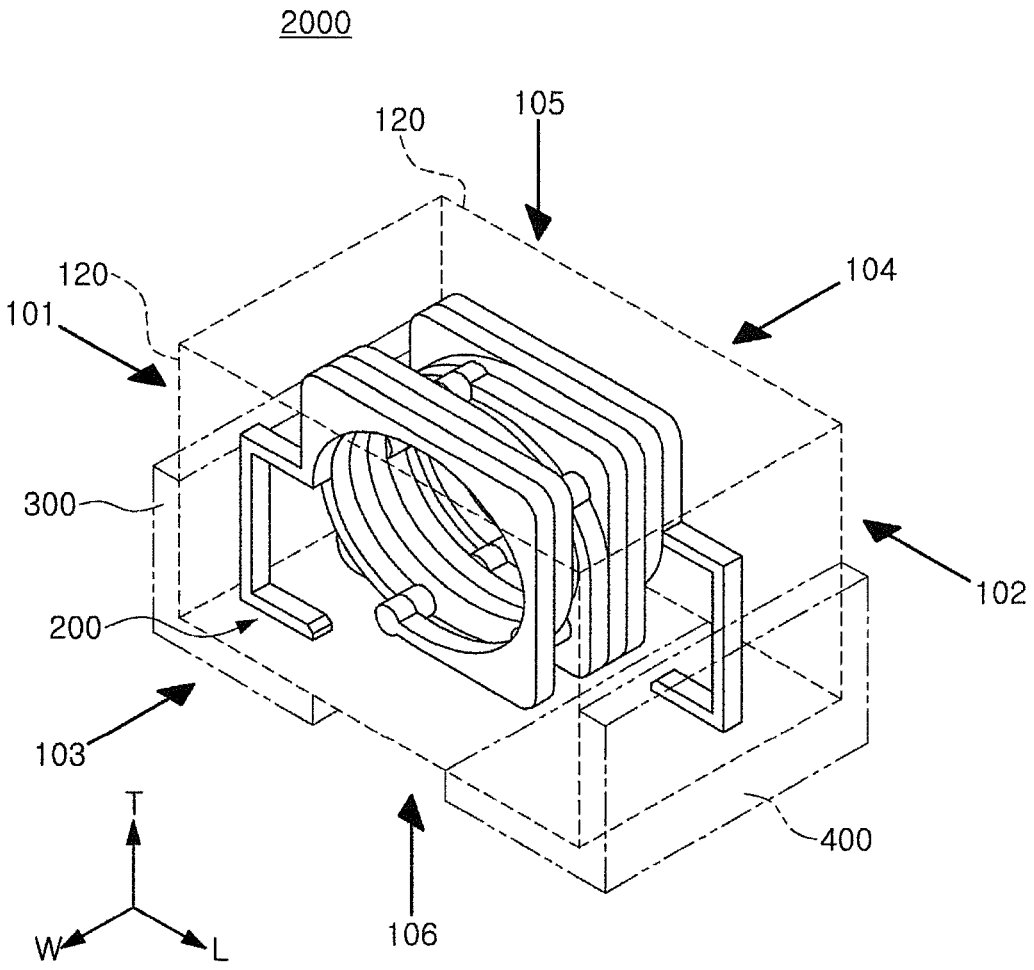
FIG. 5 is a view schematically illustrating a coil component according to another exemplary embodiment of the present disclosure.
Figure 6:
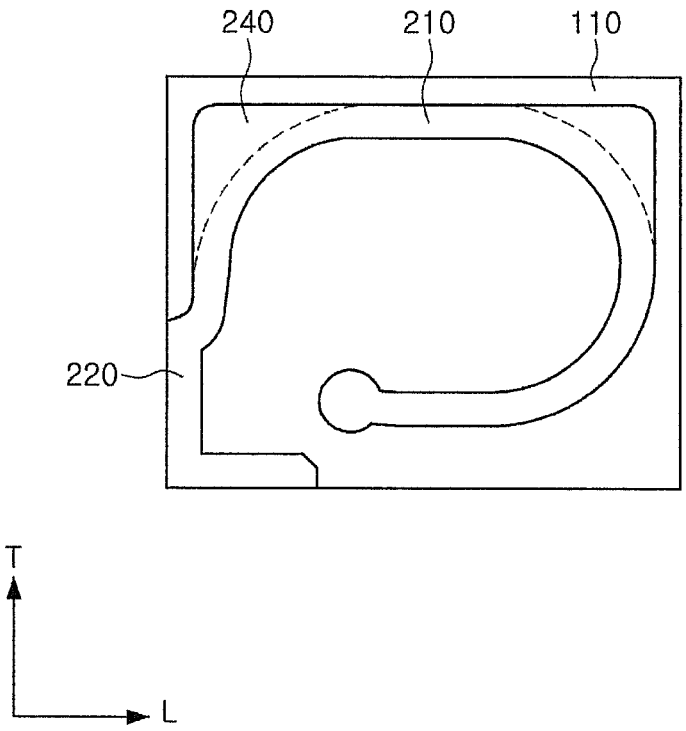
FIG. 6 is a view illustrating an uppermost effective layer applied to another exemplary embodiment of the present disclosure.

FIG. 5 is a view schematically illustrating a coil component according to another exemplary embodiment of the present disclosure. FIG. 6 is a view illustrating an uppermost effective layer applied to another exemplary embodiment of the present disclosure.

Referring to FIGS. 5 to 6, a coil component 2000 according to an exemplary embodiment of the present disclosure may have a different stacking direction of effective layers 110 and a different coil portion 200, compared to the coil component 1000 according to the first embodiment of the present disclosure. Therefore, only the stacking direction of the effective layers 110 and the coil portion 200, different from that of the first embodiment of the present disclosure, will be described in describing this embodiment. The remaining configuration of this embodiment may be applied as it is in the first embodiment of the present disclosure.

This embodiment of the present disclosure may be different from the first embodiment of the present disclosure in view of the fact that effective layers 110 are stacked in a width direction W. For example, although the first embodiment of the present disclosure is configured that a lower surface of the cover layer 120 disposed in the lowermost portion in the thickness direction T based on the direction of FIG. 1 is the sixth surface 106 of the body 100, a component mounting surface, this embodiment is configured that side surfaces of each effective layers 110 and a cover layer 120 is a sixth surface 106 of a body 100, a component mounting surface.

Due to the above-described differences, in this embodiment, a core 130 may be disposed in the body 100 in the width direction W, and a coil portion 200 may be formed in a form winding the core 130 a plurality of times in the width direction W.

In this embodiment, a lead-out pattern 220 may be exposed from the sixth surface 106 of the body 100, respectively. As a result, external electrodes 300 and 400 may be formed together only on the sixth surface 106 of the body 100 to be spaced apart from each other. As illustrated in FIG. 5, the external electrodes 300 and 400 may be formed on the sixth surface 106 of the body 100, and may extend to first and second surfaces 101 and 102 of the body 100. In this case, bonding force between the body 100 and the external electrodes 300 and 400 may be improved. In this case, as illustrated in FIG. 5, the lead-out pattern 220 may be formed to be exposed together from the sixth surface 106 of the body 100 and the first and second surfaces 101 and 102 of the body 100, to improve bonding force between the external electrodes 300 and 400.

In this embodiment, since a coil pattern 210 of the coil portion 200 may be disposed in the body 100, to be perpendicular to the sixth surface 106 of the body 100, a component mounting surface, noise generated in a mounting substrate due to the coil portion 200 may be minimized. In addition, since the coil portion 200 may be formed to be wound in the width direction W, even when the number of turns of the coil portion 200 increases, a thickness of the component may not increase.

According to the present disclosure, the decrease in the inductance (Ls) of the coil component may be minimized while reducing the DC resistance (Rdc) of the coil component.

While example embodiments have been illustrated and described above, it will be apparent to those skilled in the art that modifications and variations could be made without departing from the scope of the present disclosure as defined by the appended claims.

What is claimed is:

1. A coil component comprising:

a body including a plurality of effective layers stacked in one direction;

a coil portion embedded in the body, the coil portion including a plurality of coil patterns respectively disposed in the plurality of effective layers, the coil portion further including a lead-out pattern; and a core penetrating through an interior of the coil portion, wherein the coil portion further includes a resistance reducing portion extending from an outer circumferential surface of each of the coil patterns to an outside of the core in a respective one of the effective layers in a radially outward direction of the coil portion, and wherein the resistance reducing portion is arranged between a vertex of each of the effective layers and a respective one of the coil patterns.

2. The coil component according to claim 1, wherein the resistance reducing portion is disposed, in plural, in each of the coil patterns.

3. The coil component according to claim 1, wherein the coil portion has a polygonal shape having an interior penetrated through by the core and an exterior having rounded vertices, when the effective layers, the coil portion, and the core are projected in the one direction.

4. The coil component according to claim 3, wherein the core has a circular or elliptical shape.

5. The coil component according to claim 1, wherein each of the coil patterns is formed in less than a turn.

6. The coil component according to claim 1, further comprising first and second external electrodes disposed on at least one surface of the body and connected to the lead-out pattern.

7. The coil component according to claim 1, further comprising first and second external electrodes arranged with being spaced apart from each other on one surface of the body, parallel to the one direction, wherein the lead-out pattern is exposed from the one surface of the body and connected to the first and second external electrodes.

8. The coil component according to claim 1, wherein each of the effective layers includes a magnetic powder particle and an insulating resin.

9. The coil component according to claim 1, wherein each of the effective layers includes a dielectric powder particle and an insulating resin.

10. The coil component according to claim 1, wherein the coil portion further includes a via penetrating through each of the effective layers to connect adjacent coil patterns to each other.

11. A coil component comprising:

a coil portion including a plurality of coil patterns connected to each other; and a body including a core formed by stacking a plurality of effective layers in which the coil patterns are respectively disposed, the core penetrating through an interior of each of the coil patterns, wherein each of the coil patterns includes at least one resistance reducing portion extending to an outside of each of the coil patterns, opposing the interior of each of the coil patterns, to increase a cross-sectional area of each of the coil patterns, wherein a cross-sectional area of the at least one resistance reducing portion increases and then decreases in a circumferential direction of the core.

12. The coil component according to claim 11, wherein any one of the at least one resistance reducing portion is arranged between a vertex of a corresponding one of the effective layers and a center axis of the core.

13. The coil component according to claim 11, wherein the at least one resistance reducing portion is disposed, in plural, in each of the coil patterns.

14. The coil component according to claim 11, wherein the coil portion has a polygonal shape having an interior penetrated through by the core and an exterior having rounded vertices, when the effective layers, the coil portion, and the core are projected in one direction in which the plurality of effective layers are stacked.

15. The coil component according to claim 14, wherein the core has a circular or elliptical shape.

16. A coil component comprising:

a body including a plurality of effective layers stacked in one direction;

a coil portion embedded in the body, the coil portion including a plurality of coil patterns respectively disposed in the plurality of effective layers, the coil portion further including first and second lead-out patterns on opposite ends of the coil portion; and a core penetrating through an interior of each of the coil patterns, wherein at least one of the plurality of coil patterns includes a resistance reducing portion and a portion having a via, in a radial direction of the coil portion, a width of the resistance reducing portion is larger than a width of the at least one of the coil patterns, and the resistance reducing portion of the at least one of the coil patterns is arranged between a vertex of a corresponding one of the effective layers and a center axis of the core.

17. The coil component according to claim 16, further comprising first and second external electrodes disposed on at least one surface of the body and respectively connected to the first and second lead-out patterns.

18. The coil component according to claim 16, wherein the at least one of the plurality of coil patterns includes first and second vias disposed on opposite ends thereof, and wherein the resistance reducing portion is arranged between the first and second vias.

19. The coil component according to claim 16, wherein the at least one of the plurality of coil patterns includes a first via disposed on an end thereof and one of the first and second lead-out patterns, and wherein the resistance reducing portion is arranged between the first via and the one of the first and second lead-out patterns.

* * * * *